US007989408B2

(12) United States Patent
Poirier et al.

(10) Patent No.: US 7,989,408 B2
(45) Date of Patent: Aug. 2, 2011

(54) FUEL ECONOMY LUBRICANT COMPOSITIONS

(75) Inventors: Marc-Andre Poirier, Sarnia (CA); Olivier Sutton, Philadelphia, PA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 575 days.

(21) Appl. No.: 12/080,659

(22) Filed: Apr. 4, 2008

(65) Prior Publication Data

US 2008/0255011 A1 Oct. 16, 2008

Related U.S. Application Data

(60) Provisional application No. 60/922,658, filed on Apr. 10, 2007.

(51) Int. Cl.
*C10M 105/38* (2006.01)
*C10M 101/04* (2006.01)

(52) U.S. Cl. ..... 508/486; 508/485

(58) Field of Classification Search ..... 508/486, 508/485, 465

See application file for complete search history.

(56) References Cited

U.S. PATENT DOCUMENTS

| | | | | |
|---|---|---|---|---|
| 4,683,069 | A | 7/1987 | Brewster et al. | |
| 5,064,546 | A | 11/1991 | Dasai | |
| 5,356,547 | A | 10/1994 | Arai et al. | |
| 5,534,168 | A | 7/1996 | Cleverley et al. | |
| 5,698,502 | A | 12/1997 | Pafford et al. | |
| 5,744,434 | A | 4/1998 | Schlosberg et al. | |
| 5,906,969 | A | 5/1999 | Fyfe | |
| 5,962,381 | A | 10/1999 | Bovington | |
| 6,177,387 | B1 | 1/2001 | Schlosberg et al. | |
| 6,713,439 | B2 | 3/2004 | Watts | |
| 6,803,350 | B2 | 10/2004 | Lantuejoul et al. | |
| 2002/0072478 | A1 * | 6/2002 | Ishida et al. | 508/192 |
| 2003/0166473 | A1 | 9/2003 | Deckman et al. | |
| 2004/0192565 | A1 | 9/2004 | Thiel et al. | |
| 2004/0242434 | A1 | 12/2004 | Yagishita et al. | |
| 2005/0026790 | A1 * | 2/2005 | Komatsubara et al. | 508/160 |
| 2005/0070450 | A1 | 3/2005 | Roby et al. | |
| 2006/0073991 | A1 * | 4/2006 | Winemiller et al. | 508/192 |
| 2006/0079413 | A1 | 4/2006 | Kocsis et al. | |
| 2006/0183652 | A1 | 8/2006 | Fujitsu et al. | |
| 2006/0189489 | A1 | 8/2006 | Fujitsu et al. | |
| 2006/0276354 | A1 | 12/2006 | Donaghy et al. | |
| 2007/0133554 | A1 | 6/2007 | Ederer et al. | |
| 2007/0232506 | A1 | 10/2007 | Gao et al. | |
| 2007/0265176 | A1 | 11/2007 | Poirier et al. | |
| 2007/0298987 | A1 | 12/2007 | Poirier et al. | |
| 2008/0002425 | A1 | 1/2008 | Lin | |
| 2008/0242568 | A1 | 10/2008 | Poirier | |

FOREIGN PATENT DOCUMENTS

| | | | |
|---|---|---|---|
| EP | 1 299 509 | B1 | 8/2004 |
| EP | 1 688 476 | A1 | 8/2006 |
| WO | WO 01/59037 | A2 | 8/2001 |
| WO | WO 01/88067 | A2 | 11/2001 |
| WO | WO 2007/133554 | A2 | 11/2007 |
| WO | WO 2008/002125 | A2 | 1/2008 |
| WO | WO 2008/002425 | A1 | 1/2008 |

* cited by examiner

*Primary Examiner* — Walter D Griffin
*Assistant Examiner* — Frank C Campanell
(74) *Attorney, Agent, or Firm* — Robert A. Migliorini

(57) ABSTRACT

The present invention provides a lubricating composition comprising a major amount of a GTL lubricating base oil and a friction modifier consisting essentially of oil soluble fatty acid esters of a polyol. Such lubricating compositions have reductions in their friction coefficients that are greater than similar compositions formulated with Group III or PAO base oils.

8 Claims, No Drawings

FUEL ECONOMY LUBRICANT COMPOSITIONS

This application claims benefit of Provisional Application 60/922,658 filed Apr. 10, 2007.

FIELD OF THE INVENTION

The present invention relates to improvements in lubricating oil compositions. In particular, the invention relates to lubricating compositions formulated for use in internal combustion engines.

BACKGROUND OF THE INVENTION

There has been an increasing concern in recent years for improving the fuel economy performance of and for reducing the emission from internal combustion engines, particularly gasoline-fueled engines and diesel-fueled engines. Indeed, new engine oil specifications are requiring oil formulators to develop formulations containing less phosphorous while also reducing engine wear. Moreover, while the performance specifications have been increased, allowable treat rates for lubricant performance additives have been reduced.

Friction modifiers are typically used in engine oils to improve fuel efficiency. Such additives generally are either metal-containing compounds or ashless (non-metal-containing) organic compounds.

The trend toward low-ash lubricating compositions has focused oil formulators efforts on using ashless friction modifiers.

Ashless friction modifiers typically include fatty acid esters, fatty acid amides, organic dithiocarbamates or dithiophosphates.

In some instances, lubricant performance characteristics have been attained by a combination of specific lubricant additives that provide a synergistic result. For example, in US 2006/0189489 A1, the combination of glycerol monooleate and a nitrile compound purportedly shows synergistic friction reduction of a lubricating oil.

SUMMARY OF THE INVENTION

It has now been discovered that the use of one or more oil-soluble fatty acid esters of a polyol in a lubricating composition having a base oil comprising a major amount of a gas-to-liquid (GTL) derived base oil results in a greater reduction in the friction coefficient than if used with other Group III oils or with polyalpha olefin (PAO) oils. Preferably, the fatty acid ester is a fatty acid ester of glycerol, more preferably, a mono ester of glycerol, and most preferably, the ester is glycerol monooctadecanoate.

In one embodiment of the invention, a lubricating oil composition is provided containing an oil of lubricating viscosity comprising a major amount of at least one GTL base stock and a friction modifier consisting essentially of one or more oil-soluble fatty acid esters of a polyol.

A method for reducing the friction coefficient of a GTL base oil is also provided.

DETAILED DESCRIPTION OF THE INVENTION

The present invention relates to the use of one or more oil-soluble fatty acid esters of a polyol as friction modifying agents in a lubricating oil composition comprising a major amount of a gas-to-liquid (GTL) base stock(s).

In the present application, the term base stock is usually referred to a single oil secured from a single crude source and subjected to a single processing scheme and meeting a particular specification. The term base oils refers to oils prepared from at least one base stock.

GTL base stock are derived from GTL materials, a description of which follows.

GTL materials are materials that are obtained via one or more synthesis, combination, transformation, rearrangement, and/or degradation/deconstructive processes from gaseous carbon-containing compounds. Preferably the GTL material are derived from synthesis gas such as in the Fischer-Tropsch (FT) synthesis process wherein a synthesis gas comprising a mixture of $H_2$ and CO is catalytically converted into hydrocarbons, usually waxy hydrocarbons, that are generally converted to lower boiling materials by hydroisomerisation, and/or dewaxing. These processes are well known to those skilled in the art.

The base stock(s) used preferably according to the present invention are FT derived base stock(s).

GTL base stock(s), especially, FT base stock(s) are characterized typically as having kinematic viscosities at 100° C. of from about 2 $mm^2/s$ to about 50 $mm^2/s$, preferably from about 3 $mm^2/s$ to about 50 $mm^2/s$, more preferably from about 3.5 $mm^2/s$ to about 30 $mm^2/s$. The GTL base stock(s) used in the present invention often have kinematic viscosities in the range of about 3.5 $mm^2/s$ to 7 $mm^2/s$, preferably about 4 $mm^2/s$ to about 7 $mm^2/s$, more preferably about 4.5 $mm^2/s$ to 6.5 $mm^2/s$ at 100° C. Reference herein to kinematic viscosity refers to a measurement made by ASTM method D445.

GTL base stock(s) have most often pour points of about −5° C. or lower, preferably about −10° C. or lower, more preferably about −15° C. or lower, still more preferably about −20° C. or lower, and under some conditions may have advantageous pour points of about −25° C. or lower, with useful pour points of about −30° C. to about −40° C. or lower. In the present invention, however, the GTL base stocks are those having pour points of about −30° C. or higher, preferably about −25° C. or higher, more preferably about −20° C. or higher. References herein to pour point refer to measurement made by ASTM D97 and similar automated versions.

The GTL base stock(s), especially FT base stock(s), and other such wax-derived base stock(s) which are base stock components which can be used in this invention are also characterized typically as having viscosity indices of 80 or greater, preferably 100 or greater, and more preferably 120 or greater. Additionally, in certain particular instances, the viscosity index of these base stocks may be preferably 130 or greater, more preferably 135 or greater, and even more preferably 140 or greater. References herein to viscosity index refer to ASTM method D2270. A typical GTL base stock used in the present invention has a kinematic viscosity of about 4 $mm^2/s$ at 100° C. and a viscosity index of about 130 or greater.

The GTL base stock(s) are typically highly paraffinic (>90% saturates), and may contain mixtures of monocyclo-paraffins and multicyclo-paraffins in combination with non-cyclic isoparaffins. The ratio of the naphthenic (i.e., cycloparaffin) content in such combinations depends on the hydroisomerisation/dewaxing conditions used for their preparation. Further, GTL base stock(s) typically have very low sulfur and nitrogen content, generally containing less than about 10 ppm, and more typically less than about 5 ppm of each of these elements. The sulfur and nitrogen content of GTL base stock and base oil obtained by the hydroisomerization/isodewaxing of F-T material is essentially nil, e.g., lower than about 10 ppm and more typically less than about 5 ppm.

In a preferred embodiment, the GTL base stock(s) comprises paraffinic materials that consist predominantly of non-cyclic isoparaffins and only minor amounts of cycloparaffins. These GTL base stock(s) typically comprise paraffinic materials that consist of greater than 60 wt % non-cyclic isoparaffins, preferably greater than 80 wt % non-cyclic isoparaffins, more preferably greater than 85 wt % non-cyclic isoparaffins, and most preferably greater than 90 wt % non-cyclic isoparaffins.

Useful compositions of GTL base stock(s) are recited in U.S. Pat. Nos. 6,080,301; 6,090,989, and 6,165,949 for example.

The term GTL base stock/base oil and/or wax isomerate base stock/base oil as used herein and in the claims is to be understood as embracing individual fractions of GTL base stock as recovered in the production process or mixtures of two or more GTL base stocks GTL base stock(s) have a beneficial kinematic viscosity advantage over conventional API Group II and Group III base stocks, and so may be very advantageously used with the instant invention. Such GTL base stocks and base oils can have significantly higher kinematic viscosities, up to about 10-20 $mm^2/s$ at 100° C., whereas by comparison commercial Group II base oils can have kinematic viscosities, up to about 15 $mm^2/s$ at 100° C., and commercial Group III base oils can have kinematic viscosities, up to about 10 $mm^2/s$ at 100° C. The higher kinematic viscosity range of GTL base stocks and base oils, compared to the more limited kinematic viscosity range of Group II and Group III base stocks and base oils, in combination with the instant invention can provide additional beneficial advantages in formulating lubricant compositions.

A preferred GTL base stock is one comprising paraffinic hydrocarbon components in which the extent of branching, as measured by the percentage of methyl hydrogens (BI), and the proximity of branching, as measured by the percentage of recurring methylene carbons which are four or more carbons removed from an end group or branch ($CH_2$>4), are such that: (a) BI−0.5($CH_2$>4)>15; and (b) BI+0.85 ($CH_2$>4)<45 as measured over said liquid hydrocarbon composition as a whole.

The preferred GTL base stock can be further characterized, if necessary, as having less than 0.1 wt % aromatic hydrocarbons, less than 20 wppm nitrogen containing compounds, less than 20 wppm sulfur containing compounds, a pour point of less than −18° C., preferably less than −30° C., a preferred BI>25.4 and ($CH_2$>4)<22.5. They have a nominal boiling point of 370° C.+. On average, they average fewer than 10 hexyl or longer branches per 100 carbon atoms and on average have more than 16 methyl branches per 100 carbon atoms. They also can be characterized by a combination of dynamic viscosity, (DV) as measured by cold cranking simulator (CCS) at −40° C., and kinematic viscosity (KV), as measured at 100° C. represented by the formula: DV (at −40° C.)<2900 (KV at 100° C.)−7000.

The preferred GTL base stock is also characterized as comprising a mixture of branched paraffins characterized in that the lubricant base stock contains at least 90% of a mixture of branched paraffins, wherein said branched paraffins are paraffins having a carbon chain length of about $C_{20}$ to about $C_{40}$, a molecular weight of about 280 to about 562, a boiling range of about 650° F. to about 1050° F., and wherein said branched paraffins contain up to four alkyl branches and wherein the free carbon index of said branched paraffins is at least about 3.

In the above the Branching Index (BI), Branching Proximity (CH2>4), and Free Carbon Index (FCI) are determined as follows:

Branching Index

A 359.88 MHz 1 H solution NMR spectrum is obtained on a Bruker 360 MHz AMX spectrometer using 10% solutions in CDCl3. TMS is the internal chemical shift reference. CDCl3 solvent gives a peak located at 7.28. All spectra are obtained under quantitative conditions using 90 degree pulse (10.9 s), a pulse delay time of 30 s, which is at least five times the longest hydrogen spin-lattice relaxation time (T1), and 120 scans to ensure good signal-to-noise ratios.

H atom types are defined according to the following regions:

9.2-6.2 ppm hydrogens on aromatic rings;

6.2-4.0 ppm hydrogens on olefinic carbon atoms;

4.0-2.1 ppm benzylic hydrogens at the -position to aromatic rings;

2.1-1.4 ppm paraffinic CH methine hydrogens;

1.4-1.05 ppm paraffinic CH2 methylene hydrogens;

1.05-0.5 ppm paraffinic CH3 methyl hydrogens.

The branching index (BI) is calculated as the ratio in percent of non-benzylic methyl hydrogens in the range of 0.5 to 1.05 ppm, to the total non-benzylic aliphatic hydrogens in the range of 0.5 to 2.1 ppm.

Branching Proximity ($CH_2$>4)

A 90.5 MHz3CMR single pulse and 135 Distortionless Enhancement by Polarization Transfer (DEPT) NMR spectra are obtained on a Brucker 360 MHzAMX spectrometer using 10% solutions in CDCL3. TMS is the internal chemical shift reference. CDCL3 solvent gives a triplet located at 77.23 ppm in the 13C spectrum. All single pulse spectra are obtained under quantitative conditions using 45 degree pulses (6.3 s), a pulse delay time of 60 s, which is at least five times the longest carbon spin-lattice relaxation time (T1), to ensure complete relaxation of the sample, 200 scans to ensure good signal-to-noise ratios, and WALTZ-16 proton decoupling.

The C atom types $CH_3$, $CH_2$, and CH are identified from the 135 DEPT 13C NMR experiment. A major $CH_2$ resonance in all 13C NMR spectra at 29.8 ppm is due to equivalent recurring methylene carbons which are four or more removed from an end group or branch ($CH_2$>4). The types of branches are determined based primarily on the 13C chemical shifts for the methyl carbon at the end of the branch or the methylene carbon one removed from the methyl on the branch.

Free Carbon Index (FCI). The FCI is expressed in units of carbons, and is a measure of the number of carbons in an isoparaffin that are located at least 5 carbons from a terminal carbon and 4 carbons way from a side chain. Counting the terminal methyl or branch carbon as "one" the carbons in the FCI are the fifth or greater carbons from either a straight chain terminal methyl or from a branch methane carbon. These carbons appear between 29.9 ppm and 29.6 ppm in the carbon-13 spectrum. They are measured as follows:

(a) calculate the average carbon number of the molecules in the sample which is accomplished with sufficient accuracy for lubricating oil materials by simply dividing the molecular weight of the sample oil by 14 (the formula weight of $CH_2$);

(b) divide the total carbon-13 integral area (chart divisions or area counts) by the average carbon number from step a. to obtain the integral area per carbon in the sample;

(c) measure the area between 29.9 ppm and 29.6 ppm in the sample; and (d) divide by the integral area per carbon from step b. to obtain FCI.

Branching measurements can be performed using any Fourrier Transform NMR spectrometer. Preferably, the measurements are performed using a spectrometer having a magnet of 7.0 T or greater. In all cases, after verification by Mass Spectrometry, UV or an NMR survey that aromatic carbons were absent, the spectral width was limited to the saturated carbon region, about 0-80 ppm vs. TMS (tetramethylsilane). Solutions of 15-25 percent by weight in chloroform-d1 were excited by 45 degrees pulses followed by a 0.8 sec acquisition time. In order to minimize non-uniform intensity data, the proton decoupler was gated off during a 10 sec delay prior to the excitation pulse and on during acquisition. Total experiment times ranged from 11-80 minutes. The DEPT and APT sequences were carried out according to literature descriptions with minor deviations described in the Varian or Bruker operating manuals.

DEPT is Distortionless Enhancement by Polarization Transfer. DEPT does not show quaternaries. The DEPT 45 sequence gives a signal for all carbons bonded to protons. DEPT 90 shows CH carbons only. DEPT 135 shows CH and $CH_3$ up and $CH_2$ 180 degrees out of phase (down). APT is Attached Proton Test. It allows all carbons to be seen, but if CH and $CH_3$ are up, then quaternaries and $CH_2$ are down. The sequences are useful in that every branch methyl should have a corresponding CH and the methyls are clearly identified by chemical shift and phase. The branching properties of each sample are determined by C-13 NMR using the assumption in the calculations that the entire sample is isoparaffinic. Corrections are not made for n-paraffins or cyclo-paraffins, which may be present in the oil samples in varying amounts. The cycloparaffins content is measured using Field Ionization Mass Spectroscopy (FIMS).

GTL base oils are of low or zero sulfur and phosphorus content. There is a movement among original equipment manufacturers and oil formulators to produce formulated oils of ever increasingly reduced sulfated ash, phosphorus and sulfur content to meet ever increasingly restrictive environmental regulations. Such oils, known as Low SAPS or Mid SAPS (Sulfated Ash, Phosphorus, Sulfur) oils, would rely on the use of base oils which themselves, inherently, are of low or zero initial sulfur and phosphorus content. Such oils when used as base oils can be formulated with additives. Even if the additive or additives included in the formulation contain sulfur and/or phosphorus the resulting formulated lubricating oils will be Low SAPS or Mid SAPS oils as compared to lubricating oils formulated using conventional mineral oil base stocks.

Formulated oils for vehicle engines (both spark ignited and compression ignited) will have a sulfur content of 0.7 wt % or less, preferably 0.4 wt % or less, more preferably 0.3 wt % or less, most preferably 0.2 wt % or less, an ash content of 1.2 wt % or less, preferably 0.8 wt % or less, more preferably 0.5 wt % or less, and a phosphorus content of 0.18% or less, preferably 0.1 wt % or less, more preferably 0.09 wt % or less, most preferably 0.08 wt % or less, and in certain instances, even preferably 0.05 wt % or less. As noted above, the invention is based on the discovery that a lubricating composition that has a base oil comprising a major amount of a GTL oil has its friction coefficient reduced by the use of one or more oil-soluble fatty acid esters of a polyhydric alcohol.

By "major amount" is meant that at least 70 wt % or more of the total weight of the base oil will comprise GTL oil. Preferably, however, the base oil will comprise greater than about 80 wt % to 100 wt % of GTL oil. Indeed, in some instances, it is preferred that the base oil comprise about 90 wt % to about 96 wt % of GTL oil and from about 4 wt % to about 10 wt % of a secondary oil. The secondary oils are from Group I, II, III, IV and V oils as defined by API and ATIEL.

Composition containing from 0 to 25 wt % and in some instances 4 to 10 wt % of polyalphaolefins (PAO) provide good results.

The friction modifier used in the present invention is one or more fatty acid esters of a polyol. Polyols include diols, triols and the like such as ethylene glycol, propylene glycol, glycerol, sorbitol, to mention few. In the present invention the esters of these polyols are those of carboxylic acids having 12 to 24 carbon atoms. Examples of such carboxylic acids include octadecanoic acid, dodecanoic acid, stearic acid, lauric acid and oleic acid. Preferably, the fatty acid ester is a glycerol ester, more preferably, a glycerol monoester. The preferred fatty acid moiety of the ester is a stearic or octadecanoic acid. Typically, the friction modifier is used in an effective amount, for example, from about 0.05 wt % to about 3 wt % and preferably from about 0.3 wt % to about 1.0 wt % based on the total weight of the lubricating composition. The lubricating composition may be formulated as straight grade or multi-grade compositions with appropriate lubricant additives used in gasoline and diesel engine oils.

Typical crankcase lubricant additives include dispersants, detergents, antiwear additives, antioxidants, VI improvers, pour point depressants, rust inhibitors and antifoamants.

Useful dispersants are borated and non-borated nitrogen containing compounds made from high molecular weight mono and di-carboxylic acids and amines. Dispersants are generally used in amounts from about 0.5 to 10 wt % but preferably from about 3 wt % to about 5 wt % based on the total weight of the lubricating composition.

Useful detergents include calcium or magnesium salicylates, phenates or sulfonates. They are generally used in amounts from 0.5 wt % to about 6 wt % but preferably from about 3 wt % to about 5 wt % based on the total weight of the lubricating composition.

Suitable VI improvers are those normally used in lubricating oils such as polybutene polymers, ethylene propylene copolymer, alkyl acrylate esters, polyacrylate esters, polymethacrylate esters, A-B block copolymer such as those made by polymerization of dienes such as butadiene and/or isoprene with vinyl aromatics such as styrene and the like. These additives, pure or pre-diluted in oil, are used in amounts from about 1.5 wt % to 16 wt % but preferably from about 6 wt % to about 14 wt % based on the total weight of the lubricating composition.

Pour point depressants such as polymethacrylate esters, alkylated fumarate or maleate vinyl acetate copolymers, styrene maleate copolymers can be used in amount from about 0.1 wt % to about 1 wt % but preferably from about 0.2 to about 0.3 wt % based on the total weight of the lubricating composition.

The invention is further illustrated by the following examples.

EXAMPLE 1

Three fluid oil formulations (Fluids 1, 2, and 3) were prepared using three different base oils. Each of the fluids contained the same additives in identical amounts. From each of these fluids, an additional fluid (Fluids 4, 5 and 6) was prepared by adding 0.6 wt % of glycerol monooctadecanoate to each of Fluids 1, 2 and 3. A description of the fluids is presented below.

TABLE 1

| | Fluid 1 Wt % | Fluid 2 Wt % | Fluid 3 Wt % |
|---|---|---|---|
| GTL Base Oils | 74.3 | | |
| Group III Base Oils, Visom | | 74.3 | |

TABLE 1-continued

| | | | |
|---|---|---|---|
| Group III Base Oils, Yubase | | | 74.3 |
| VI Improver | 12.45 | 12.45 | 12.45 |
| Detergents | 2.5 | 2.5 | 2.5 |
| Dispersant | 8.0 | 8.0 | 8.0 |
| Aminic and Phenolic Antioxidant | 1.5 | 1.5 | 1.5 |
| Antiwear and AntiFriction Agents | 1.0 | 1.0 | 1.0 |
| Pour Point Depressant | 0.2 | 0.2 | 0.2 |
| Silicone Defoamant | 0.05 | 0.05 | 0.05 |
| Properties | | | |
| Sulfated Ash, wt % | <1.2 | <1.2 | <1.2 |
| Phosphorus, wt % | <0.104 | <0.104 | <0.104 |
| KV @ 40° C., mm2/s | 53.04 | 61.61 | 57.21 |
| KV @ 100° C., mm2/s | 10.13 | 10.73 | 10.54 |
| VI | 182 | 166 | 177 |

| | Fluid 4 | Fluid 5 | Fluid 6 |
|---|---|---|---|
| Fluid 1 + 0.6 wt % glycerol monooctadecanoate | □ | | |
| Fluid 2 + 0.6 wt % glycerol monooctadecanoate | | □ | |
| Fluid 3 + 0.6 wt % glycerol monooctadecanoate | | | □ |

EXAMPLE 2

The coefficient of friction of the fluids in Example 1 was determined by the High-Frequency Reciprocating Rig (HFRR) according to ASTM D6079 test method but using the following test conditions:

Fluid volume: 2 mL
Stroke length: 1.0 mm
Frequency: 60 Hz
Applied load: 400 g
Temperature: 60 to 160° C. (2° C./min temperature program)

TABLE 2

HFRR Test Results

| | | Temperature, ° C. | | | | | | |
|---|---|---|---|---|---|---|---|---|
| | | 60 | 80 | 100 | 120 | 140 | 160 | Average |
| Fluid 1 | Friction Coefficient | 0.102 | 0.108 | 0.108 | 0.110 | 0.114 | 0.104 | 0.108 |
| Fluid 4 | Friction Coefficient | 0.076 | 0.079 | 0.077 | 0.078 | 0.080 | 0.075 | 0.078 |
| % Friction | Reduction | 25.5 | 26.9 | 28.7 | 29.1 | 29.8 | 27.9 | 27.8 |
| Fluid 2 | Friction Coefficient | 0.085 | 0.090 | 0.090 | 0.088 | 0.084 | 0.093 | 0.088 |
| Fluid 5 | Friction Coefficient | 0.078 | 0.085 | 0.094 | 0.063 | 0.079 | 0.084 | 0.081 |
| % Friction | Reduction | 8.2 | 5.6 | −4.2 | 28.4 | 5.9 | 9.7 | 8.0 |
| Fluid 3 | Friction Coefficient | 0.099 | 0.096 | 0.084 | 0.088 | 0.094 | 0.103 | 0.094 |
| Fluid 6 | Friction Coefficient | 0.083 | 0.086 | 0.091 | 0.091 | 0.089 | 0.072 | 0.085 |
| % Friction | Reduction | 16.1 | 10.4 | −7.7 | −3.3 | 5.3 | 30.1 | 9.6 |

What is claimed is:

1. A method for reducing the coefficient of friction of lubricating oil compositions comprising base oils and friction modifiers by using as the base oil a major amount of a base oil comprising greater than about 70 wt % of at least one GTL base stock and as the friction modifier a minor amount of a friction modifier consisting essentially of one or more fatty acid esters of a polyol, wherein the coefficient of friction is reduced compared to lubricating oil compositions containing base oils other than the at least one GTL base stock.

2. The method of claim 1 wherein the friction modifier is a monoester of glycerol.

3. The method of claim 2 wherein the friction modifier is present in an amount ranging from about 0.05 wt % to about 2 wt % based on the total weight of the lubricating composition.

4. The method of claim 3 wherein the friction modifier is glycerol monooctadecanoate.

5. The method of claim 1 wherein the base oil contains from 0 wt % to about 25 wt % of polyalphaolefins (PAOs).

6. The method of claim 5 including one or more engine lubricant additives selected from detergents, dispersants, antiwear additives, pour point depressants, antioxidants, VI improvers, rust inhibitors and antifoamants.

7. A method for reducing the coefficient of friction of lubricating oil compositions comprising base oils and friction modifiers by using as the base oil a major amount of a base oil comprising about 70 wt % of at least one GTL base stock, and as the friction modifier a minor amount of a friction modifier selected from the group consisting essentially of one or more glycerol monooctadecanoate, glycerol monostearate and glycerol monolaurate, wherein the coefficient of friction is reduced compared to lubricating oil compositions containing base oils other than the at least one GTL base stock.

8. The method of claim 1 wherein the friction modifier is present in an amount ranging from about 0.3 wt % to about 0.7 wt % based on the total weight of the lubricating composition.

* * * * *